US006006441A

United States Patent [19]

Wittler et al.

[11] Patent Number: 6,006,441

[45] Date of Patent: Dec. 28, 1999

[54] PROCESS AND APPARATUS FOR DRYING SMALL ARTICLES IN A CONTAINER

[76] Inventors: Harald Wittler, Gangesalle 21, D-41366 Schwalmtal; Olaf Horner, Auf der Hardt 10, D-35260 Stadtallendorf, both of Germany

[21] Appl. No.: 09/007,499

[22] Filed: Jan. 15, 1998

[30] Foreign Application Priority Data

Jan. 15, 1997 [DE] Germany ..... 197 01 154

[51] Int. Cl.[6] ..... F26B 3/08

[52] U.S. Cl. ..... 34/364; 34/442; 34/509; 34/170

[58] Field of Search ..... 34/338, 402, 433, 34/442, 487, 492, 509, 107, 168, 170, 210, 211, 214, 215, 364, 365

[56] References Cited

U.S. PATENT DOCUMENTS

| | | | |
|---|---|---|---|
| 1,472,314 | 10/1923 | Webster | 34/365 |
| 1,524,567 | 1/1925 | Plews | 34/405 |
| 2,974,419 | 3/1961 | Hauk et al. | 34/364 |
| 3,650,037 | 3/1972 | Oetiker | 34/364 |
| 3,717,434 | 2/1973 | Black | 422/112 |
| 4,939,850 | 7/1990 | Baillie | 34/364 |
| 5,019,994 | 5/1991 | Rainville | 34/484 |

FOREIGN PATENT DOCUMENTS

| | | | |
|---|---|---|---|
| 609127 | 11/1960 | Canada | 34/364 X |
| WO 94/27103 | 11/1994 | WIPO | 34/364 X |

*Primary Examiner*—Henry Bennett
*Assistant Examiner*—Steve Gravini
*Attorney, Agent, or Firm*—Mason, Kolehmainen, Rathburn & Wyss

[57] ABSTRACT

In a process and apparatus for drying small articles in a process container, such as closure elements of pharmaceutical vessels after a treatment of the closure elements, an air-permeable support is arranged beneath the articles to support them and prepared preheated air is fed to the interior of the process container and through the support to dry the articles while they are resting on the support. An additional air mass flow is at least once briefly passed under the support during the drying operation, to lift and thereby turn the small articles to ensure at least substantially complete drying thereof.

2 Claims, 1 Drawing Sheet

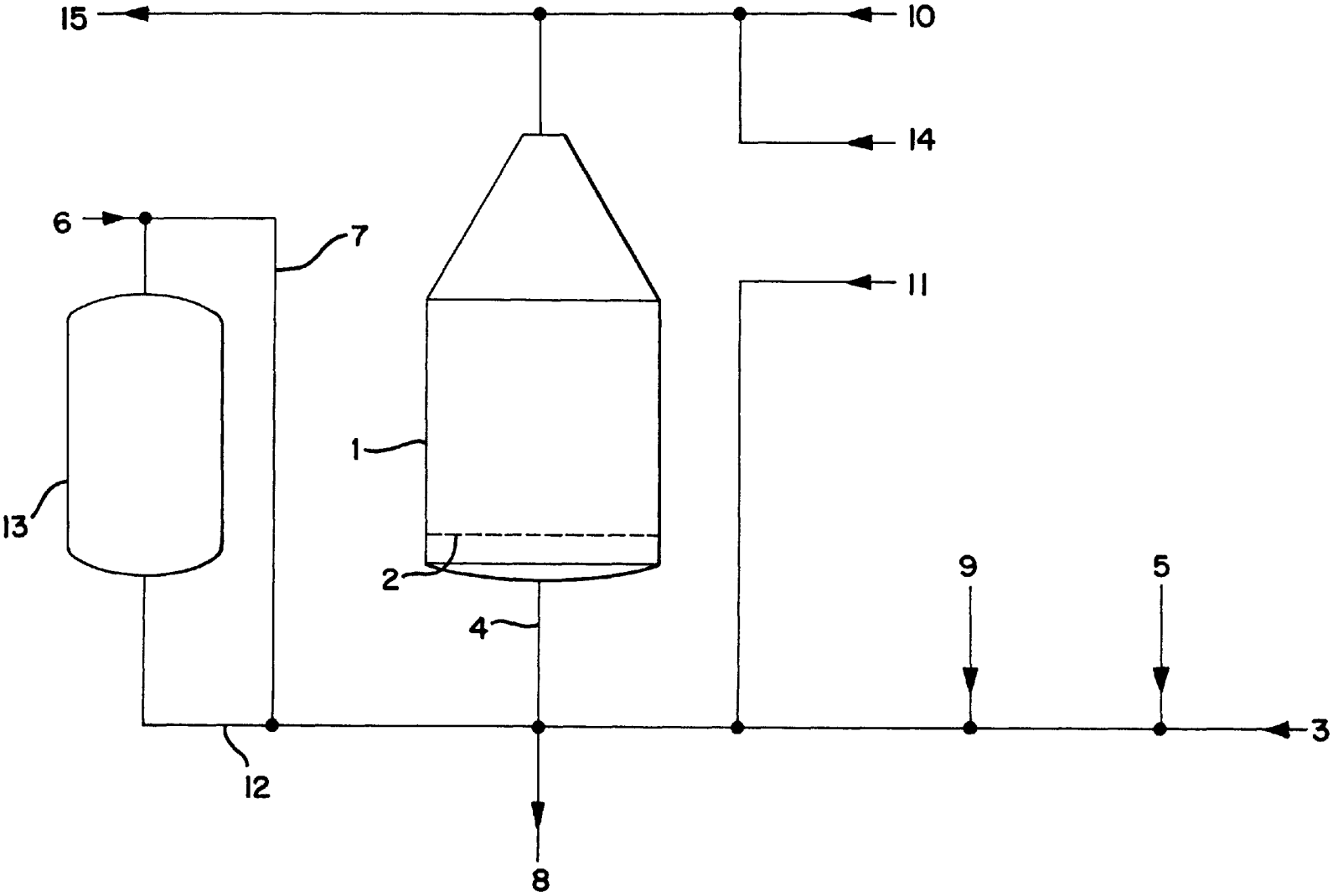
3
5
9
10
14
11
8
4
2
1
7
12
15
6
13

PROCESS AND APPARATUS FOR DRYING SMALL ARTICLES IN A CONTAINER

FIELD OF THE INVENTION

The invention relates to a process for drying small articles in a container, and an apparatus for carrying out such a process.

The small articles to be dried by the process and apparatus may be for example closure elements for pharmaceutical purposes such as stoppers or plugs for pharmaceutical vessels or the like.

BACKGROUND OF THE INVENTION

Closure elements for pharmaceutical purposes such as stoppers or plugs are often subjected to a treatment which involves firstly washing them in a washing phase by means of high-purity, germ-free water. The washing operation can be effected with or without the addition of one or more detergents. To initiate the washing phase a process container is firstly filled with the closure elements or plugs and then water is added. For the actual washing operation, the closure elements are moved by means of compressed air which is supplied to the process container. The washing water is then drained away again, after the treatment operation. The washing phase and the drainage phase may then be followed by a silicone-coating operation, in a third phase. For that purpose, hot, highly pure water is again supplied to the container, with the water being mixed with a metered amount of silicone. The water is then removed and in a subsequent further phase sterilisation is effected using steam.

After the steam sterilisation procedure, the closure elements are still wet and have to be dried before being removed from the process container. In order that few or no drops remain on the closure elements or plugs, the closure elements or plugs may be moved around in the process container in such a way that they are dried to the greatest reasonable possible extent.

To do that, the process container may be moved mechanically during the feed of hot air into same, in order thereby to provide that during the drying operation the closure elements respectively adopt different positions from their previous positions in the process container, so that the hot air can also reach those parts and regions of the closure elements which, when they were in their previous position, either bore against the inside wall surface of the process container or against other closure elements or plugs. A disadvantage in that respect is that complicated and costly equipment is required to produce the above-mentioned mechanical movement of the process container. In addition, the fact that the closure elements are continuously rubbing against each other in the drying procedure means that undesirable abrasion and erosion thereof occurs. Furthermore, particularly when dealing with silicone-coated closure elements, the drying procedure may often fall foul of the undesirable phenomenon that the closure elements or plugs stick together and thus form clumps, resulting in what can be called compacting of the closure elements within the process container.

Drying procedures can also be implemented in fluidised bed driers, in which respect attention may be directed for example to K Kroll: Trockner und Trocknungsverfahren, ['Driers and drying processes'], Springer-Verlag 1959, pages 275 ff. In such a drier air flows constantly upwardly through a layer of particles at such a rate that the particles are slightly lifted and loosened up but are not carried away by the air flow. In such a procedure all the parts of the material are continuously in movement. Such an apparatus and procedure can thus be used to dry materials which are capable of a trickle flow, which also includes plastic materials. A disadvantage in this respect however is also the fact that the movement of the particles means that they are frequently striking and knocking against each other and thus suffer from a considerable degree of abrasion and erosion. Furthermore a fluidised bed drier of that kind is not suitable for particles which have a tendency to compacting as discussed above.

DE 42 11 485 C2 describes a process for removing moisture from the interior of a solid material, for example wood. In that procedure, the wood is firstly acted upon by a high pressure which mechanically drives the moisture out of the solid material, and it is then exposed to a periodically rapidly changing pressure in order to remove the residual moisture. This operating procedure also involves the risk of severe particle abrasion and erosion, due to the continual fluctuations in pressure.

SUMMARY OF THE INVENTION

An object of the present Invention is to provide a process for drying small articles in a container which while involving low technical resources can provide for substantial drying of the articles while very substantially avoiding particle abrasion or erosion and compacting of the articles.

Still another object of the present invention is to provide a process for drying articles in a container, which can produce drying substantially all around the articles without real susceptibility to causing damage to the articles as a consequence of the drying procedure.

Yet another object of the present invention is to provide an apparatus for drying small articles in a container, which can be of a simple design configuration and involve an uncomplicated operating procedure while nonetheless affording a high level of drying effectiveness.

In accordance with the principles of the present invention the foregoing and other objects are attained by a process for drying small articles in a process container, for example closure elements for pharmaceutical vessels or the like, after the closure elements have been subjected to a treatment, in which process an air-permeable support is disposed beneath the articles and prepared preheated air is fed to the interior of the container, with the articles being shifted in position relative to the container by air in such a way that at least substantially complete drying thereof occurs. The articles are dried by the air while they are resting on the support. During the drying operation, an additional air mass flow is at least once briefly passed under the support to lift the articles and thereby turn them.

Further in accordance with the principles of the present invention in the apparatus aspect the foregoing and other objects are attained by an apparatus for drying articles disposed in a process container, the apparatus having a support of perforated configuration so as to be air-permeable adapted to be disposed beneath the articles, a feed means for feeding prepared preheated air into the container and through the support, whereby air flows into the container and through the support, a pressure draft tank means under an increased pressure in relation to the pressure in the container, a conduit means connecting the pressure draft tank means to the container and communicating with the container beneath said support, and a control means for at least once feeding an additional air mass flow out of said pressure draft tank means Into said container.

Further objects, features and advantages of the invention will be apparent from the following description of a preferred embodiment thereof.

BRIEF DESCRIPTION OF THE DRAWING

The single FIGURE of the accompanying drawing is a diagrammatic view of a process container and a pressure draft tank with appropriate conduit connections.

DESCRIPTION OF THE PREFERRED EMBODIMENT

Referring to the drawing, it will firstly be noted that valves which are required to control the operating procedure of the installation are not illustrated therein.

Reference numeral 1 denotes a process container for the treatment of closure elements for pharmaceutical purposes, such as plugs or stoppers, for example for pharmaceutical vessels or the like. The treatment includes a washing phase, possibly a silicone-coating phase, a subsequent sterilisation phase and a following drying phase. The present invention is only specifically concerned in this respect with the drying phase.

As shown, the process container 1 has a support which is generally indicated at 2 and which is air-permeable, for example by being of a perforated nature, for supporting the closure elements such as plugs or stoppers. The closure elements are introduced into the process container 1 by way of a suitable filling opening (not shown). The process container 1 is supplied by way of a diagrammatically illustrated connection 3 with water in a high state of purity (referred to as WFI or Water For Injection), by way of a suitable pipe connection and an agent pipe 4 for introducing one or more agents into the process container 1. One or more detergents may possibly be added by way of a connection as indicated at 5. For the washing operation compressed air is fed to the interior of the process container 1 by way of a connection 6 and through a conduit 7 and the pipe 4. The closure elements in the water in the process container 1 are moved around by the effect of the compressed air and the washing operation is effected thereby. The compressed air is discharged by way of an air discharge connection as indicated at 15. After the washing operation is concluded the water is drained away by way of a water drain 8.

If required a silicone-coating operation can then be effected. For that purpose, water is again introduced into the interior of the container, with silicone being added to that water by way of a suitable metering device 9. The closure elements in the process container 1 are then moved again by means of a supply of compressed air into the process container 1. After the silicone-coating operation is concluded the water is again drained away.

A sterilisation procedure is then effected. For that purpose, pure steam is supplied to the process container 1 from the top side thereof by way of a connection 10. Sterilisation is effected at about 120° C. over a period of about 20 minutes at elevated temperature. After the sterilisation operation the process container 1 is returned to atmospheric pressure.

The procedure for drying the closure elements in the process container 1 is then effected. For that purpose, heated sterile air is fed to the interior of the process container 1 by way of a connection 11 and through the pipe 4.

In order to provide that the closure elements are dried on all sides in a careful manner, that is to say in such a way as to substantially eliminate particle abrasion or erosion, an air mass flow is cyclically fed to the interior of the process container 1 by way of the pipe 4 and a conduit in the form of a process pipe 12, from a blast-pressure tank or pressure draft tank 13 which is generally identified at 13. At its side which is opposite to the process pipe 12, being therefore the upper end in the FIGURE, the tank 13 is communicated with the compressed air connection 6 so that, when the tank 13 is in a closed condition and compressed air is supplied thereto from the connection 6, an increased pressure in relation to the pressure in the process container 1 can be built up in the tank 13. Then, by way of a control unit (not shown), a metered air mass flow is fed from the tank 13 which is under an increased pressure to the process container 1, at the underside thereof, that is to say beneath the perforated support 2 supporting the closure elements in the process container 1. It will be seen that for this purpose the pipe 12 is connected to the process container 1 at a location beneath the perforated support 2. The consequence of this supply of air under pressure is that the closure elements which are resting on the support 2 are lifted and turned. In this respect, the term turn is used to indicate that the closure elements each adopt a different position in comparison with their previous position so that the hot sterile air introduced at 11 can also reach those regions of the closure elements which, when the closure elements were in the preceding position, were in contact either with the internal wall surface of the process container 1 or the surface of other closure elements. It will be noted that the additional air mass flow introduced into the process container 1 beneath the support 2 and flowing upwardly therethrough only needs to be briefly passed under the support to produce the turning effect.

It will further be noted that the procedure for transposing or turning the closure elements in the process container 1 can possibly be repeated a plurality of times until the desired degree of drying thereof has been achieved.

The process container with the closure elements disposed therein can then be swept with nitrogen by way of a connection diagrammatically indicated at 14.

It will be noted that the small articles in the container are lifted carefully and gently and then turned in such a way that the hot air can then also reach the regions thereof that were inaccessible in the previous positions of the articles, thereby ensuring drying thereof all around same, without compacting for example of silicone-coated articles.

It will be appreciated that the above-described process and apparatus according to the invention have been set forth solely by way of example and illustration of the principles of the invention and that various modifications and alterations may be made therein without thereby departing from the spirit and scope of the invention.

What is claimed is:

1. A process for drying small articles having a plurality of sides in a process container after a treatment of said articles, said process comprising the steps of:

disposing said articles on an air-permeable support secured in position in said process container, feeding preheated air to the interior of the process container to dry the articles while said articles are resting on the support, and providing at least once during the drying operation an additional air mass flow from under the support to thereby lift the articles away from said support and thereby change the position of said articles relative to said support in the process container such that the articles are dried on all of said sides thereof.

2. Apparatus for drying articles having a plurality of sides in a process container, said apparatus comprising:

a perforated support for supporting the articles, said support being secured in position in the process container;

a feed means for feeding preheated air into the process container beneath the support to dry the articles on the support;

a pressure draft tank means;

a means for pressurizing said tank means to an increased pressure in relation to the pressure in the process container;

a conduit means for connecting said tank means to the process container beneath the support; and a control means for at least once feeding an additional air mass flow out of the tank means into the process container through said conduit means to thereby lift the articles away from said support and thereby change the position of said articles relative to said support in the process container such that the articles are dried on all of said sides thereof.

* * * * *